US011027915B2

(12) United States Patent
Rana

(10) Patent No.: US 11,027,915 B2
(45) Date of Patent: Jun. 8, 2021

(54) BAG HOLDER APPARATUS

(71) Applicant: Sean Rana, Brampton (CA)

(72) Inventor: Sean Rana, Brampton (CA)

( * ) Notice: Subject to any disclaimer, the term of this patent is extended or adjusted under 35 U.S.C. 154(b) by 0 days.

(21) Appl. No.: 15/940,005

(22) Filed: Mar. 29, 2018

(65) Prior Publication Data

US 2018/0282058 A1 Oct. 4, 2018

Related U.S. Application Data

(60) Provisional application No. 62/480,366, filed on Apr. 1, 2017.

(51) Int. Cl.

| | |
|---|---|
| ***B65F 1/14*** | (2006.01) |
| ***B65F 1/06*** | (2006.01) |
| ***B65B 67/12*** | (2006.01) |

(52) U.S. Cl.

CPC ..... *B65F 1/1415* (2013.01); *B65F 1/06* (2013.01); *B65B 67/1233* (2013.01); *B65F 2220/108* (2013.01); *B65F 2220/1063* (2013.01)

(58) Field of Classification Search

CPC ..... B65F 1/1415; B65F 1/0073; B65F 1/06; B65F 2220/108; B65F 2220/1063; B65F 2220/106; B65F 1/141; B65B 67/12; B65B 67/1233; B65B 67/1205; B65B 67/1222; B65B 67/1227

USPC ..... 248/99–101; 220/495.08, 23.4, 751

See application file for complete search history.

(56) References Cited

U.S. PATENT DOCUMENTS 1,070,847 A * 8/1913 Schoettler ..... B65B 67/1227 248/100
1,542,164 A * 6/1925 Swan ..... B65B 67/1255 248/97
2,213,929 A * 9/1940 Hoffman ..... A61M 3/0266 248/99
2,213,937 A * 9/1940 Tompkins ..... A45F 3/20 248/99
2,235,182 A * 3/1941 Weston ..... B65B 67/1255 248/100
2,894,308 A * 7/1959 Eckstein ..... A44B 19/38 24/561
3,113,677 A * 12/1963 Johnson ..... A47G 23/0225 224/482
3,866,872 A * 2/1975 Burgess ..... B65B 67/12 248/97
4,418,835 A * 12/1983 Watts ..... B65F 1/06 220/495.1
4,457,549 A * 7/1984 Lowery ..... B65B 67/1238 294/1.4

(Continued)

*Primary Examiner* — Ingrid M Weinhold

(74) *Attorney, Agent, or Firm* — Crowe & Dunlevy, P.C.

(57) ABSTRACT

The apparatus is for use with a refuse container, a refuse bag and a plurality of clips. The container is of the type having a mouth which presents vertically upwardly in use and a rim which defines the entry to the mouth. The bag is of the type having an end portion which defines a mouth of the bag. The apparatus comprises a frame and securement apparatus. The frame, in use, is disposed at an operative position relative to the container and is engaged by the clips to suspend the bag interiorly of the container such that the mouth of the bag is open, presents upwardly and is disposed adjacent the rim of the container. The securement apparatus, in use, holds the frame at the operative position.

4 Claims, 14 Drawing Sheets

(56) References Cited

U.S. PATENT DOCUMENTS 4,562,983 A * 1/1986 Kiefbeck ..... B65B 67/12 248/97
4,889,300 A * 12/1989 Gibson ..... B65B 67/12 248/97
4,934,637 A * 6/1990 Guerrera ..... B65B 67/12 248/100
5,065,891 A * 11/1991 Casey ..... B65F 1/06 220/495.08
RE33,842 E * 3/1992 Ebentheuer ..... B65B 67/1233 248/97
5,125,605 A * 6/1992 Guerrera ..... B65B 67/12 248/100
5,154,378 A * 10/1992 Plum ..... B65B 67/12 248/99
6,017,069 A * 1/2000 Imms ..... B65B 67/1233 248/101
6,076,782 A * 6/2000 Aiderman ..... B65B 67/1205 248/97
6,176,455 B1 * 1/2001 Ma ..... B65B 67/1233 141/391
6,293,505 B1 * 9/2001 Fan ..... B65B 67/12 141/391
6,607,088 B2 * 8/2003 Cestrone ..... B65F 1/141 220/23.86
6,772,903 B1 * 8/2004 Riggins ..... B65F 1/06 220/495.08
6,994,301 B1 * 2/2006 Fox ..... B65B 67/1205 211/85.15
7,066,432 B2 * 6/2006 Wood ..... B65B 67/1205 248/150
7,284,732 B1 * 10/2007 Lopa ..... B65B 67/1233 248/101
D692,755 S * 11/2013 Curnutt ..... D9/434
D728,184 S * 4/2015 Hoggatt ..... D34/6
9,694,927 B2 * 7/2017 Smith ..... B65D 25/16
10,196,202 B1 * 2/2019 Clavizzao ..... B60N 3/08
2001/0054614 A1 * 12/2001 Cestrone ..... B65F 1/141 220/23.4
2007/0205199 A1 * 9/2007 Wothers ..... A47G 19/22 220/506
2009/0014603 A1 * 1/2009 Zima ..... B65B 67/1205 248/101
2017/0121104 A1 * 5/2017 Degnan ..... B65F 1/1415

* cited by examiner

PRIOR ART

BAG HOLDER APPARATUS

RELATED APPLICATIONS

This application claims priority to U.S. Provisional Patent Application Ser. No. 62/480,366, incorporated herein by reference in its entirety.

FIELD OF THE INVENTION

The invention relates to the field of household refuse collection.

BACKGROUND OF THE INVENTION

It is well known for households to use containers to receive refuse and for such households to use disposable bags to line such containers. It is also well known that, for sundry reasons, households often use disposable bags that are not appropriately sized [undersized] for the container, with the result that the bag cannot be suspended from the rim of the container in the conventional fashion.

SUMMARY OF THE INVENTION

Forming one aspect of the invention is apparatus for use with a refuse container and a refuse bag, the container being of the type having a mouth which presents vertically upwardly in use and a rim which defines the entry to the mouth, the bag being of the type having an end portion which defines a mouth of the bag. This apparatus comprises a bag holder and securement apparatus. The bag holder, in use, is disposed at an operative position relative to the container and suspends the bag interiorly of the container such that the mouth of the bag is open, presents upwardly and is disposed adjacent the rim of the container. The securement apparatus, in use, holds the bag holder at the operative position.

According to another aspect, the bag holder can include: a frame about which the end portion is draped in use; and a clip adapted to grip around the frame and, in use, the bag.

According to another aspect, the bag holder can comprise a plurality of clips.

According to another aspect, the frame can have a plurality of portions, each portion including a pair of elongate members disposed in angular relation; and a clip can be provided for each of said plurality of portions, the clip being adapted to grip a substantial portion of the length of each of the members of said each portion.

According to another aspect, in each portion, the elongate members of the pair can be disposed in perpendicular relation to one another.

According to another aspect, the securement apparatus can be defined by a plurality of grips, each grip having a fixed end connected to the frame and a free end which, in use, is releasably coupled to the refuse container.

According to another aspect, the free end can be a hooked end which, in use, receives the rim in gripping relation.

According to another aspect, the frame can have a plurality of linear sections; and the fixed ends of the grips can be pivotally connected to the linear sections for movement around pivot axes defines by the linear sections.

According to another aspect, the frame can be bisected into two parts, hingedly connected to one another for relative movement about a hinge axis in the manner of the leaves of a book; and the linear sections can be orientated parallel to the hinge axis.

According to another aspect, the plurality of grips can be a pair of grips, the grips being relatively elongate in the direction of the linear section to resist pivotal movement of the bag holder in the container.

According to another aspect, when the parts are disposed in coplanar relation, the frame can be substantially rectangular.

According to another aspect, in use, the mouth of the bag can be disposed beneath the rim of the container.

Forming another aspect of the invention is apparatus for use with a refuse container, a refuse bag and a plurality of clips. The container is of the type having a mouth which presents vertically upwardly in use and a rim which defines the entry to the mouth. The bag being of the type having an end portion which defines a mouth of the bag.

This apparatus comprises a frame and securement apparatus. The frame, in use, is disposed at an operative position relative to the container and is engaged by the clips to suspend the bag interiorly of the container such that the mouth of the bag is open, presents upwardly and is disposed adjacent the rim of the container. The securement apparatus, in use, holds the frame at the operative position.

Advantages, features and characteristics of the invention will become apparent upon review of the following detailed description and the appended drawings, the latter being briefly described hereinafter.

DETAILED DESCRIPTION

Figure 1:
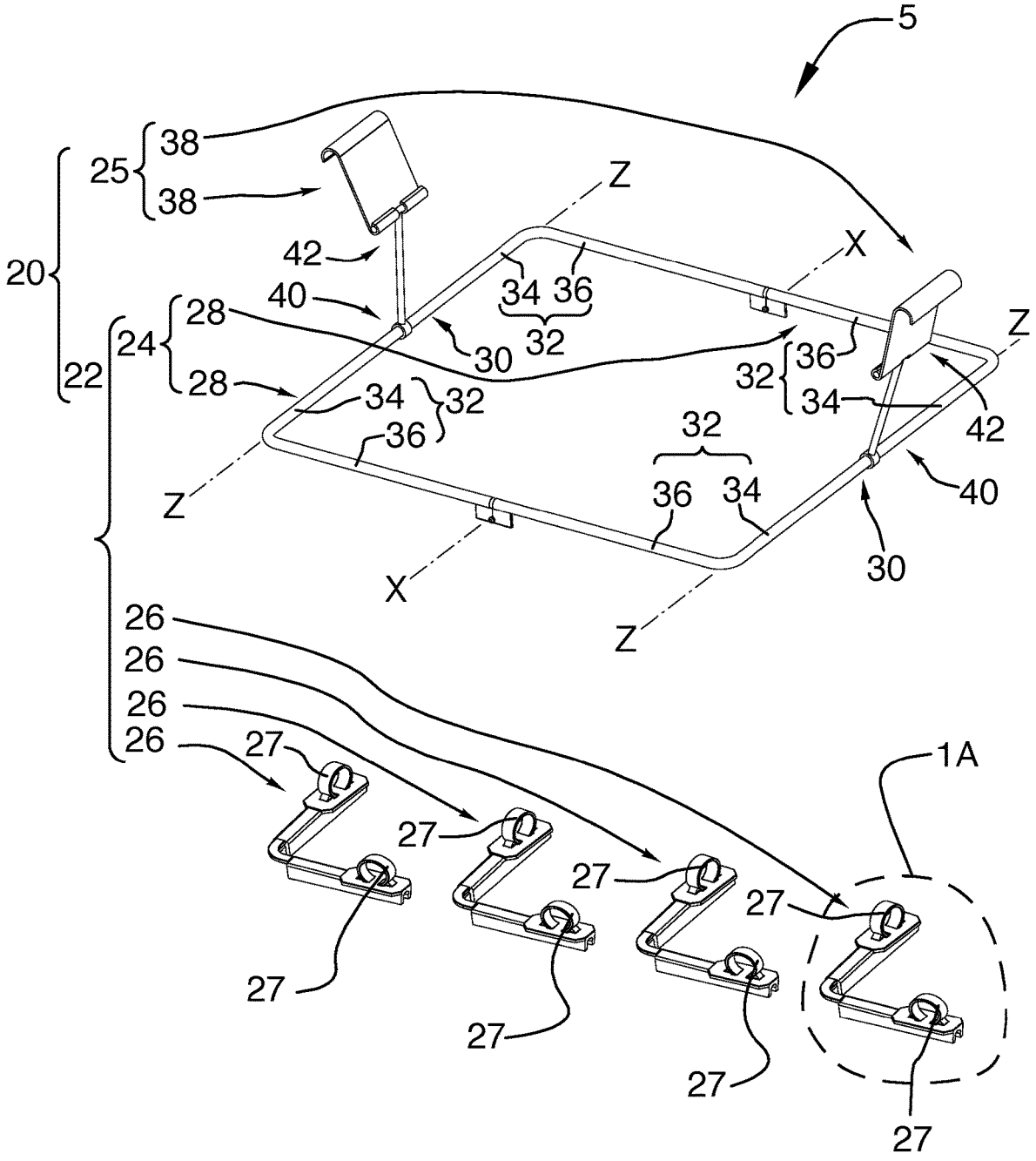
FIG. 1 shows apparatus according to an exemplary embodiment of the invention.
Figure 1A:
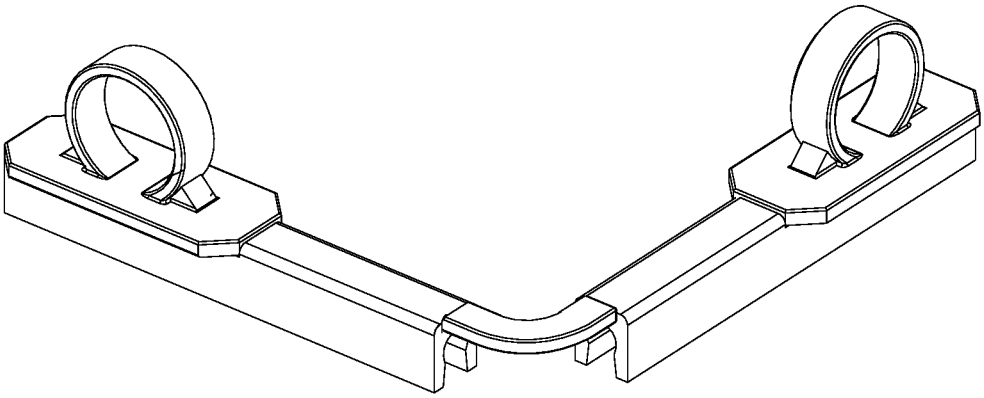
FIG. 1A is an enlarged view of the structure of encircled area 1A of FIG. 1.

FIG. 1 shows apparatus 20 according to an exemplary embodiment of the invention, which apparatus will be seen to comprise a bag holder 22 and securement apparatus 25.

The bag holder 22 includes a frame 24 and a plurality of clips 26.

The frame 24 includes two substantially planar parts 28, hingedly connected to one another for movement about a hinge axis X-X. Each part 28 includes a linear section 30 and a pair of portions 32. Linear section 30 is orientated parallel to the hinge axis X-X. Each portion 32 includes a pair of elongate members 34,36 disposed in angular, more specifically, perpendicular relation, one 34 of the pair of elongate members forming a coaxial extension of the linear section 30 such that, when the parts are disposed in opposing relation, as shown in FIG. 1, the frame is substantially rectangular and planar.

Figure 2:
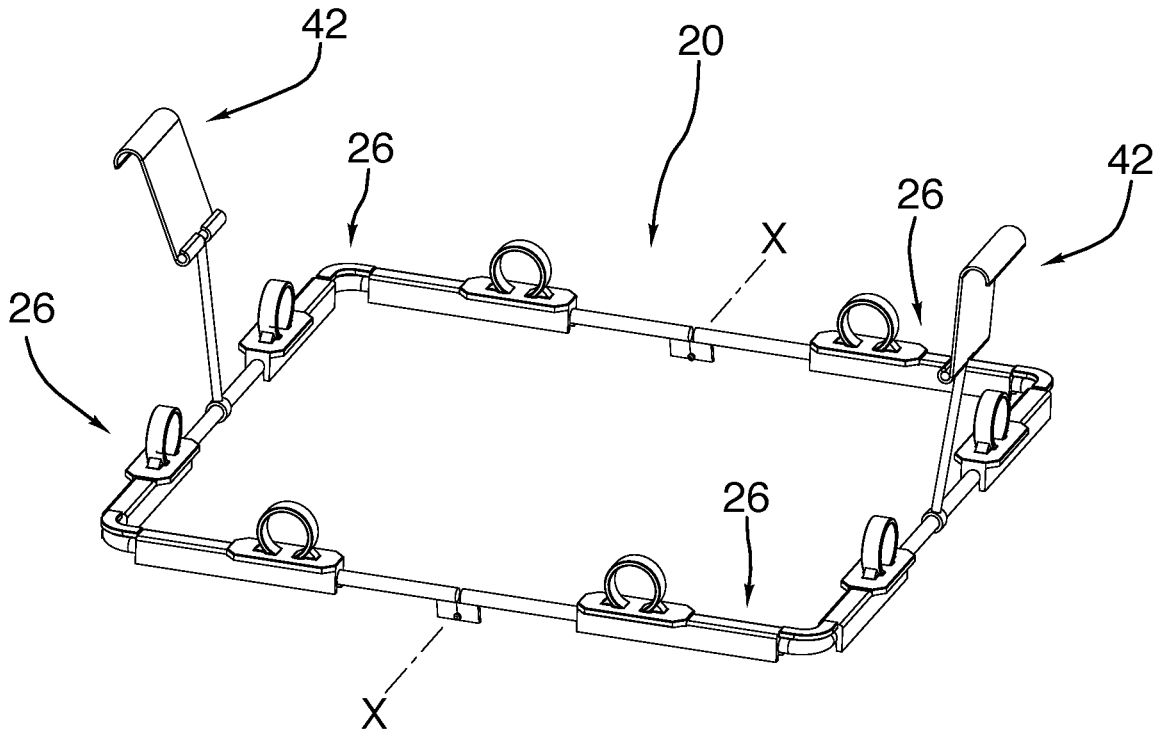
FIG. 2 shows the apparatus of FIG. 1 assembled for use.
Figure 2A:
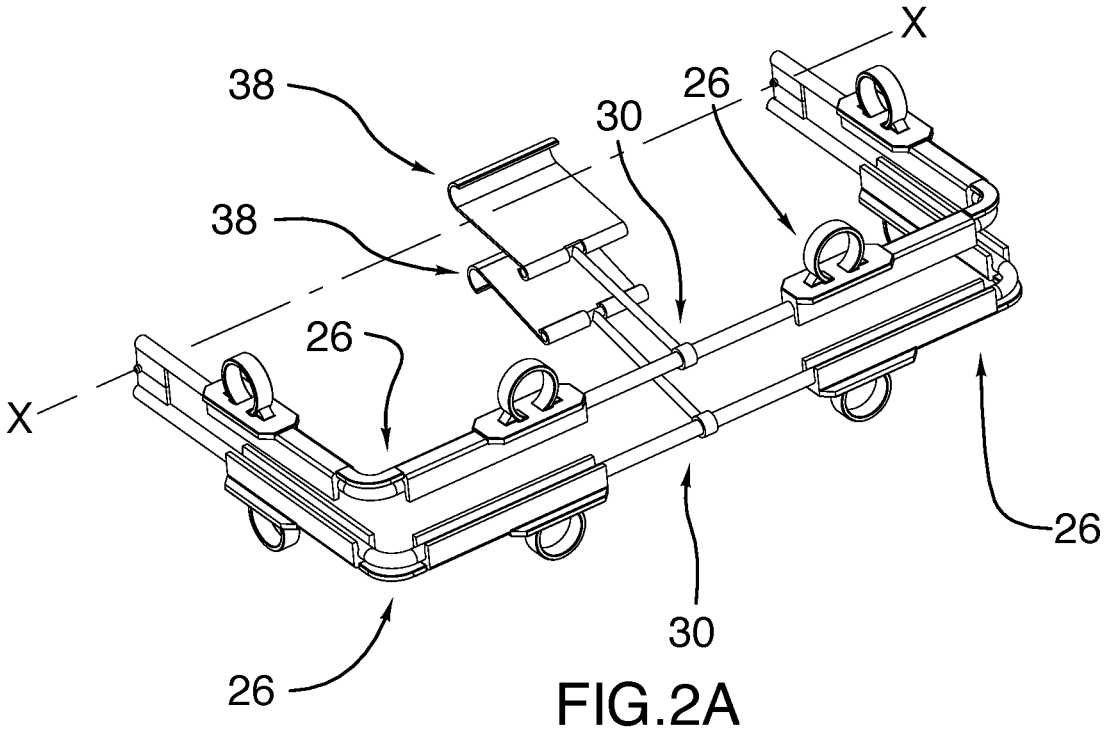
FIG. 2A shows the apparatus of FIG. 1 in a folded position.

The clips 26 are provided one for each of the plurality of portions, each clip being adapted to grip a substantial portion of the length of each of the members 34,36 of the portion for which it is provided, as shown in FIG. 2. The clips 26 will be seen to include hooks 27 which facilitate removal from the frame.

The securement apparatus 25 is defined by a plurality of grips 38, specifically, a pair of grips, one being provided for each linear section 30, each grip having a fixed end 40 and a free end 42. The fixed end 40 is pivotally connected to the linear section 30 for which it is provided for movement around a pivot axis Z-Z defined by the linear section 30. The free end 42 is a hooked end, the hooked end being relatively elongate in the direction of the linear section 30.

Figure 3:
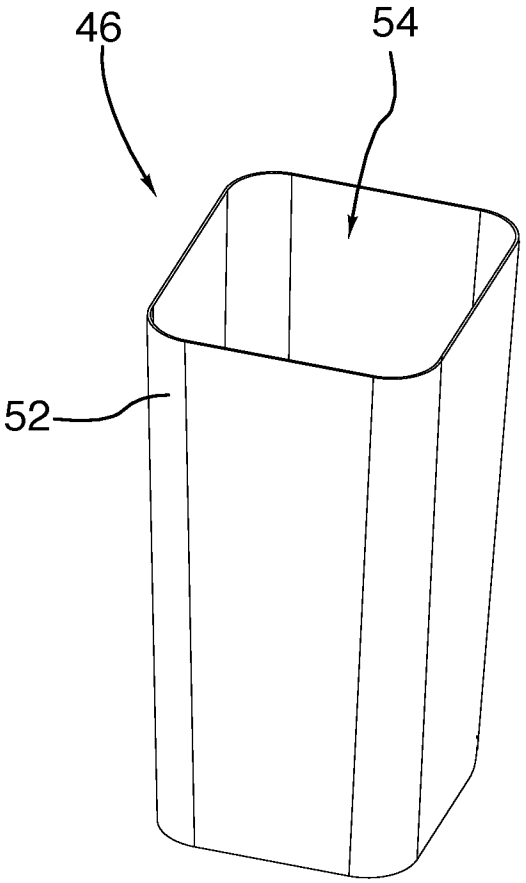
PRIOR ART FIG.3
FIG. 3 shows a refuse container and refuse bag of the prior art with which the apparatus of FIG. 1 can be used.
Figure 3:
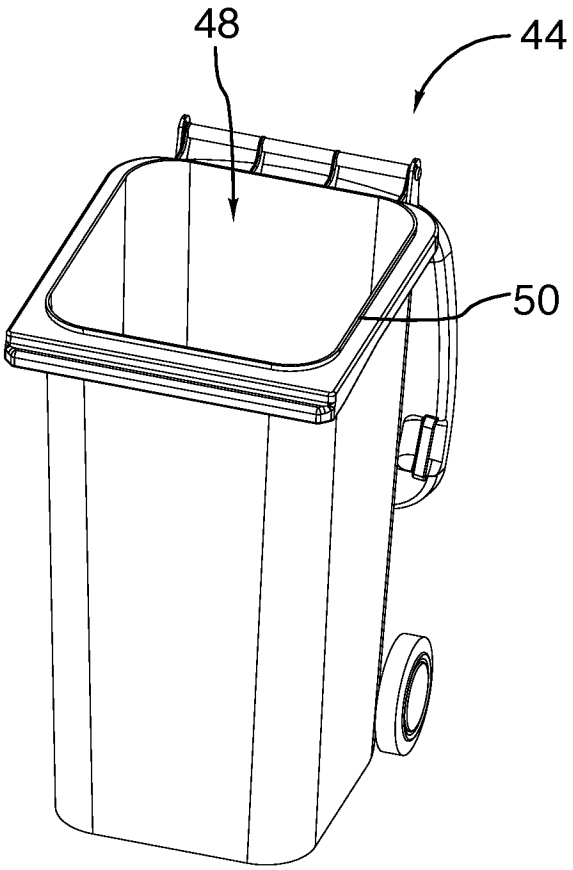
PRIOR ART FIG.3

The apparatus 20 is used with a refuse container 44 and a refuse bag 46, the container being of the prior art type having a mouth 48 which presents vertically upwardly in use and a rim 50 which defines the entry to the mouth, the bag being of the prior art type having an end portion 52 which defines a mouth 54 of the bag, all as shown in FIG. 3.

Figure 4:
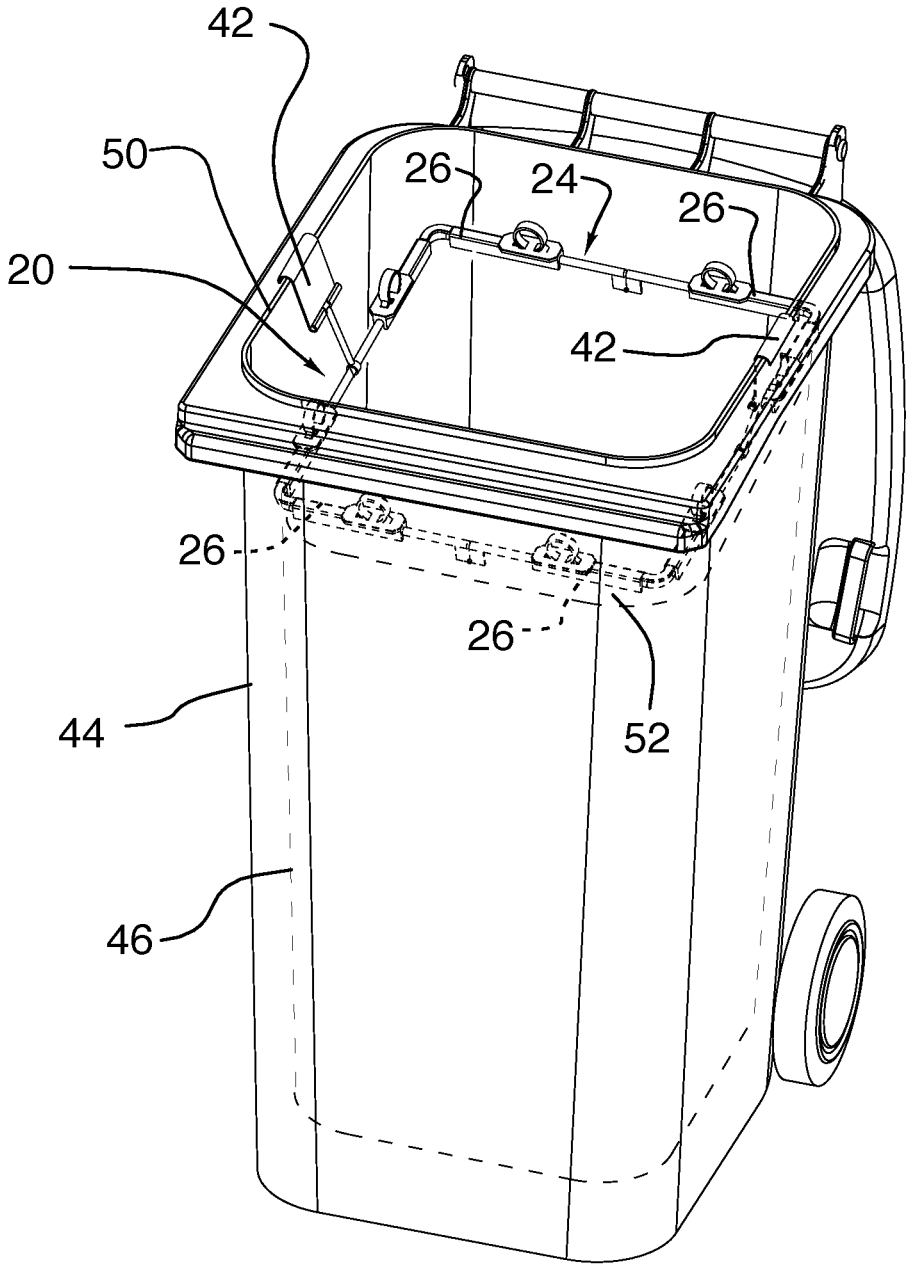
FIG. 4 shows the apparatus of FIG. 1 in use with the structure of FIG. 3.
Figure 4A:
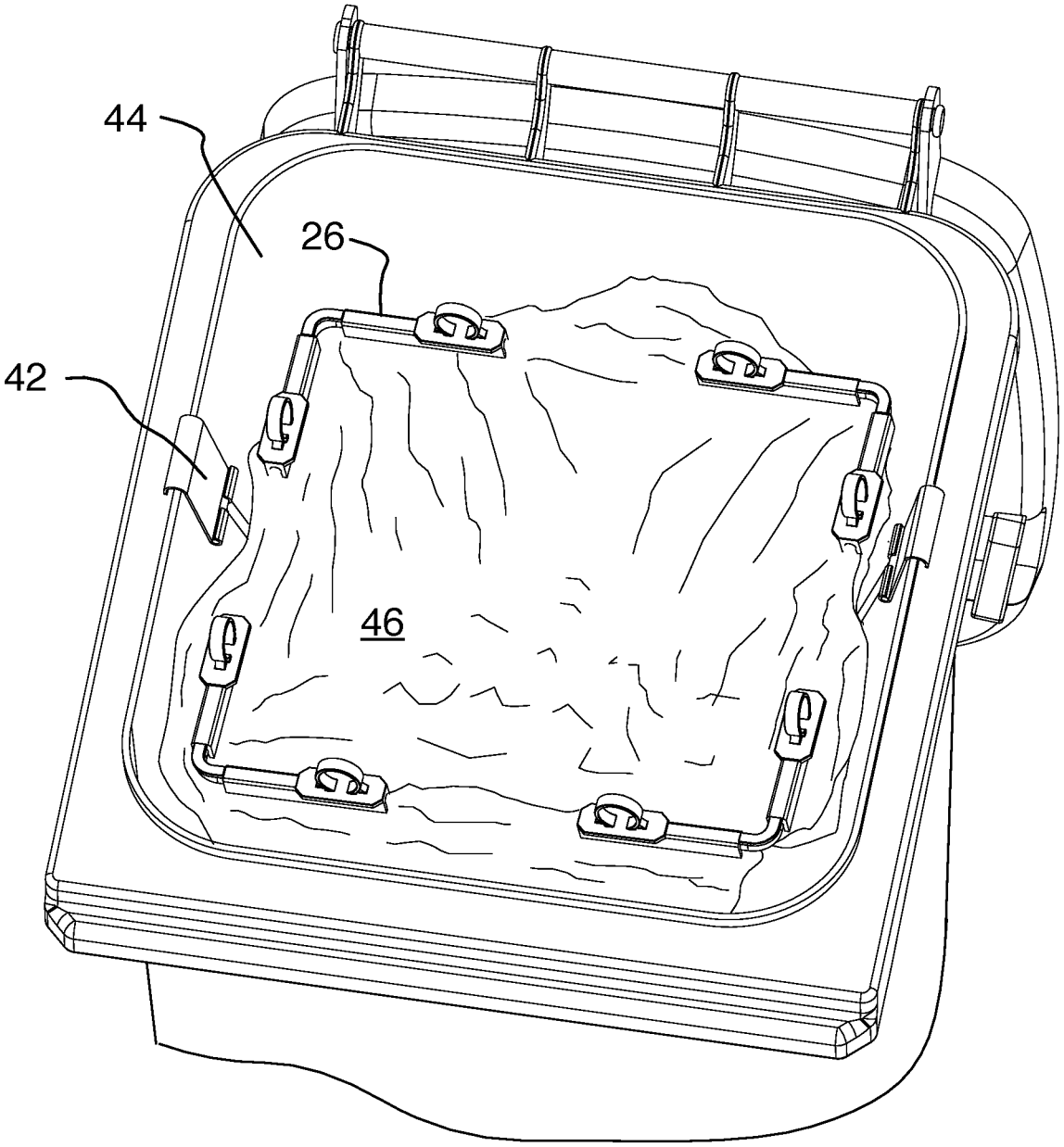
FIG. 4A shows the apparatus of FIG. 1 in use with the structure of FIG. 3.

In use, as shown in FIG. 4:

- the end portion 52 of the bag is draped around the frame 24;
- each clip 26 is disposed in gripping relation to the members 34, 36 of the portion 32 for which it is provided and that portion of the bag disposed there between; and
- each hooked end 42 receives the rim 50 in gripping relation, thereby to support the bag holder 20 in an operative position and configuration wherein the bag holder 20 suspends the bag 46 interiorly of the container such that the mouth of the bag is open, presents upwardly and is disposed beneath the rim of the container.

Whereas a specific embodiment is shown and described, it will be evident that variations are possible.

Figure 5:
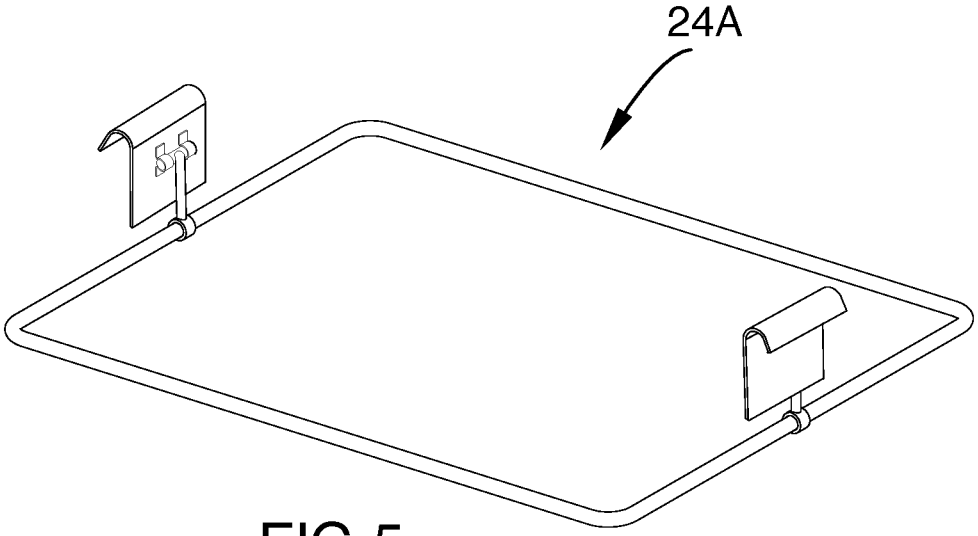
FIG. 5 shows a view of an alternate embodiment of the structure 5 of FIG. 1.
Figure 6:
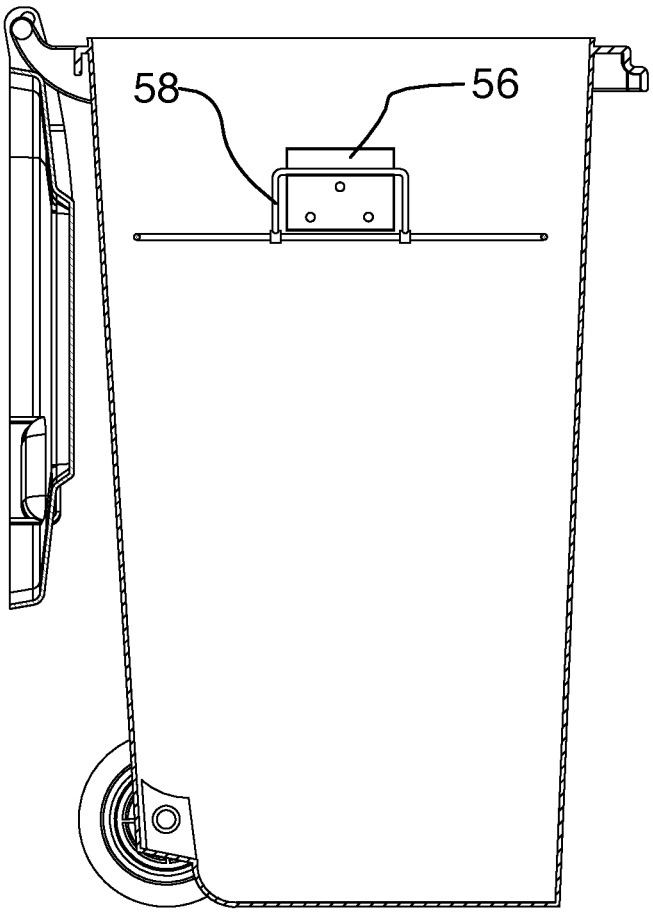
FIG. 6 shows the structure of FIG. 7 in use with a refuse container.
Figure 7:
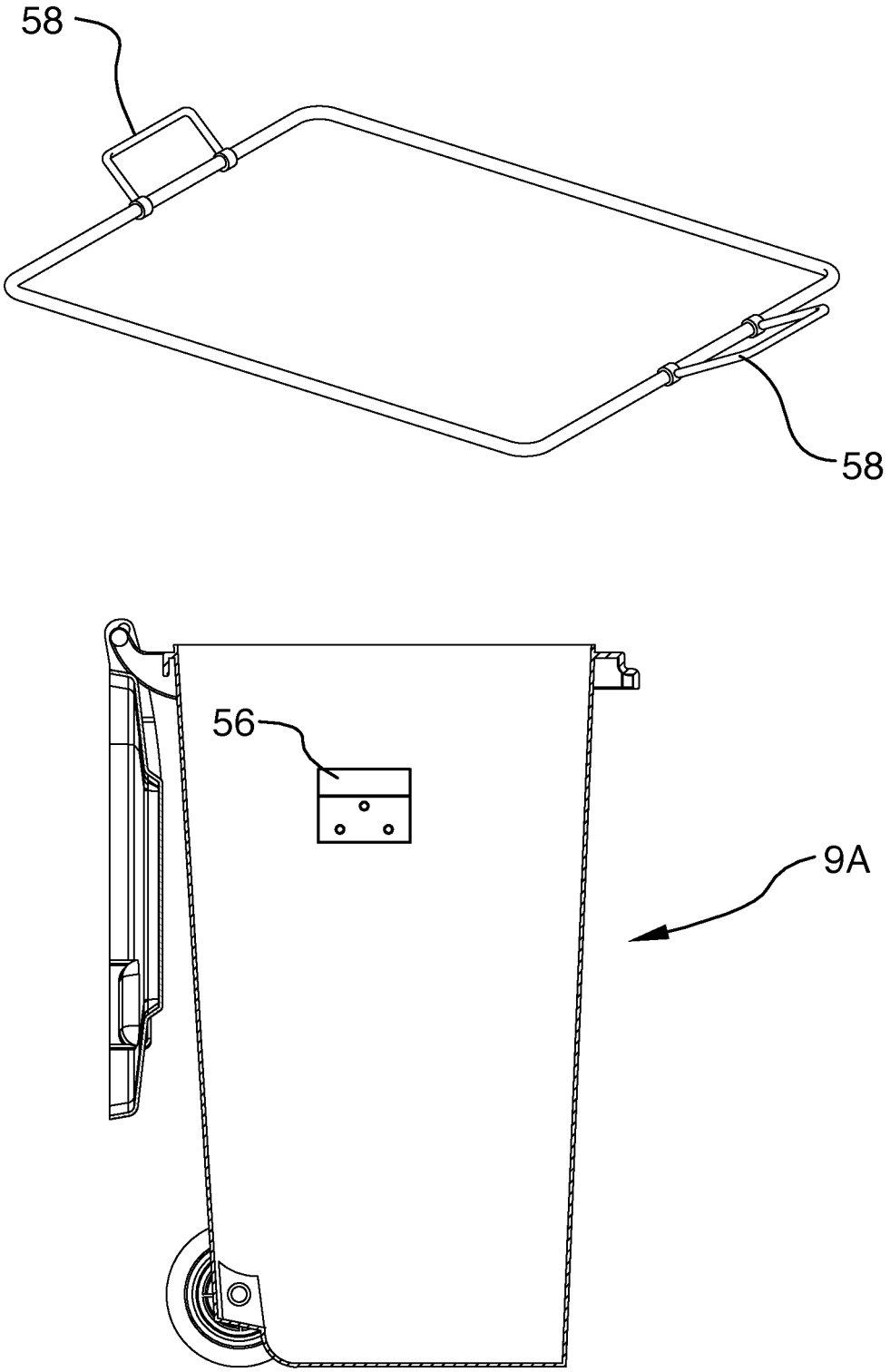
FIG. 7 is an exploded view of the structure of FIG. 6.
Figure 8:
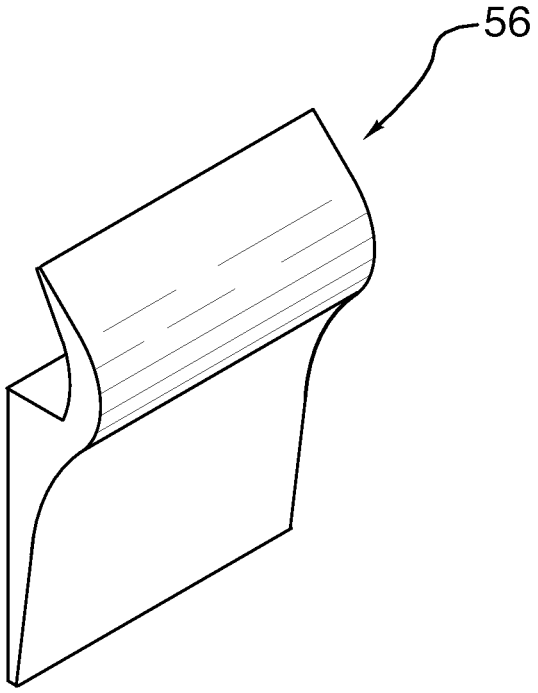
FIG. 8 is a view of the bracket 56 of FIG. 7.

For example, whereas the illustrated frame is hinged and rectangular, this is not necessary; a solid frame 24A is shown in FIG. 5. Other shapes, such as circular frames, could also of course be used; this could be of particular use in the context of round refuse containers.

Figure 9:
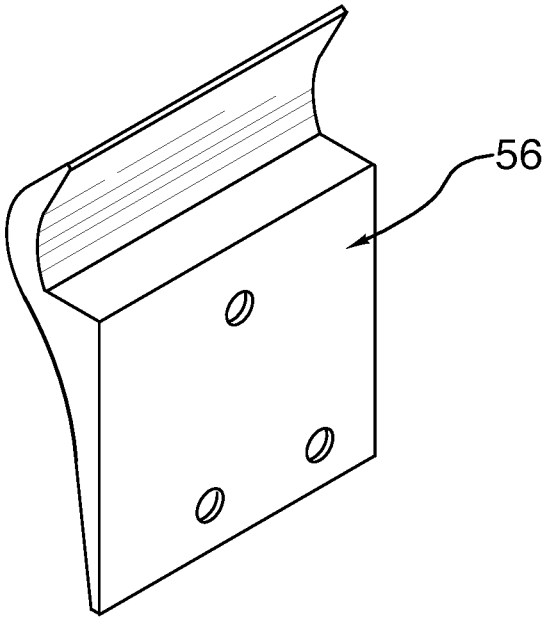
FIG. 9 is a view of the structure of FIG. 8 from another vantage point.
Figure 9A:
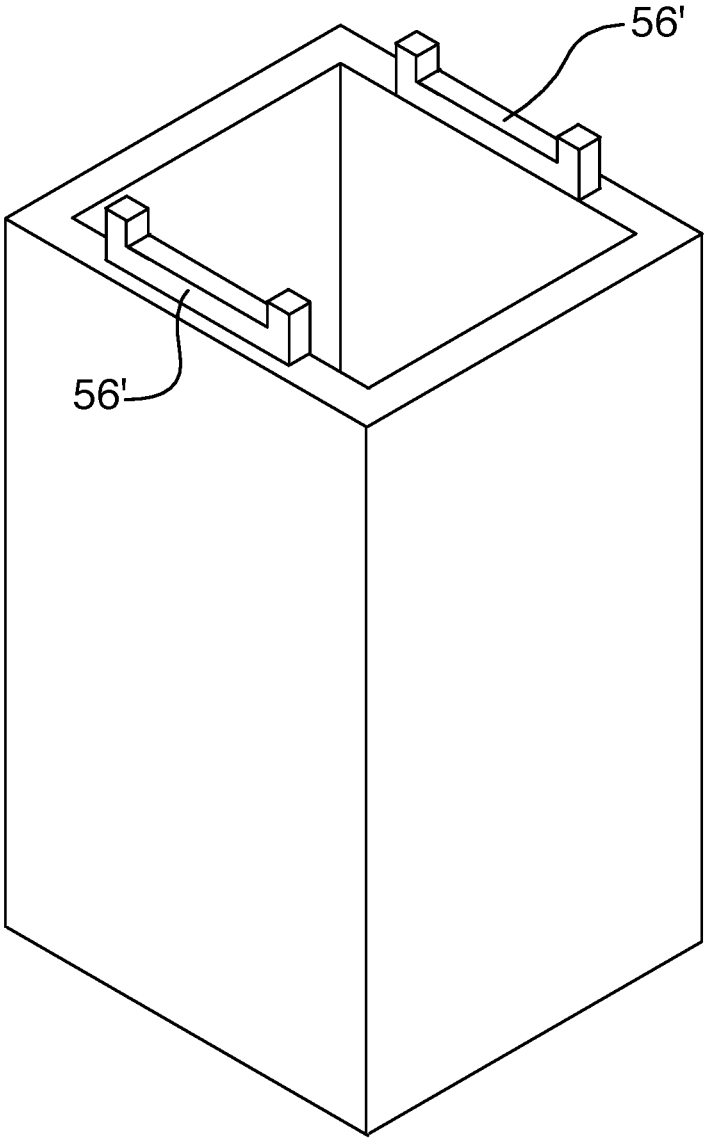
FIG. 9A is a view of an alternative embodiment of the structure of FIG. 7.
Figure 9B:
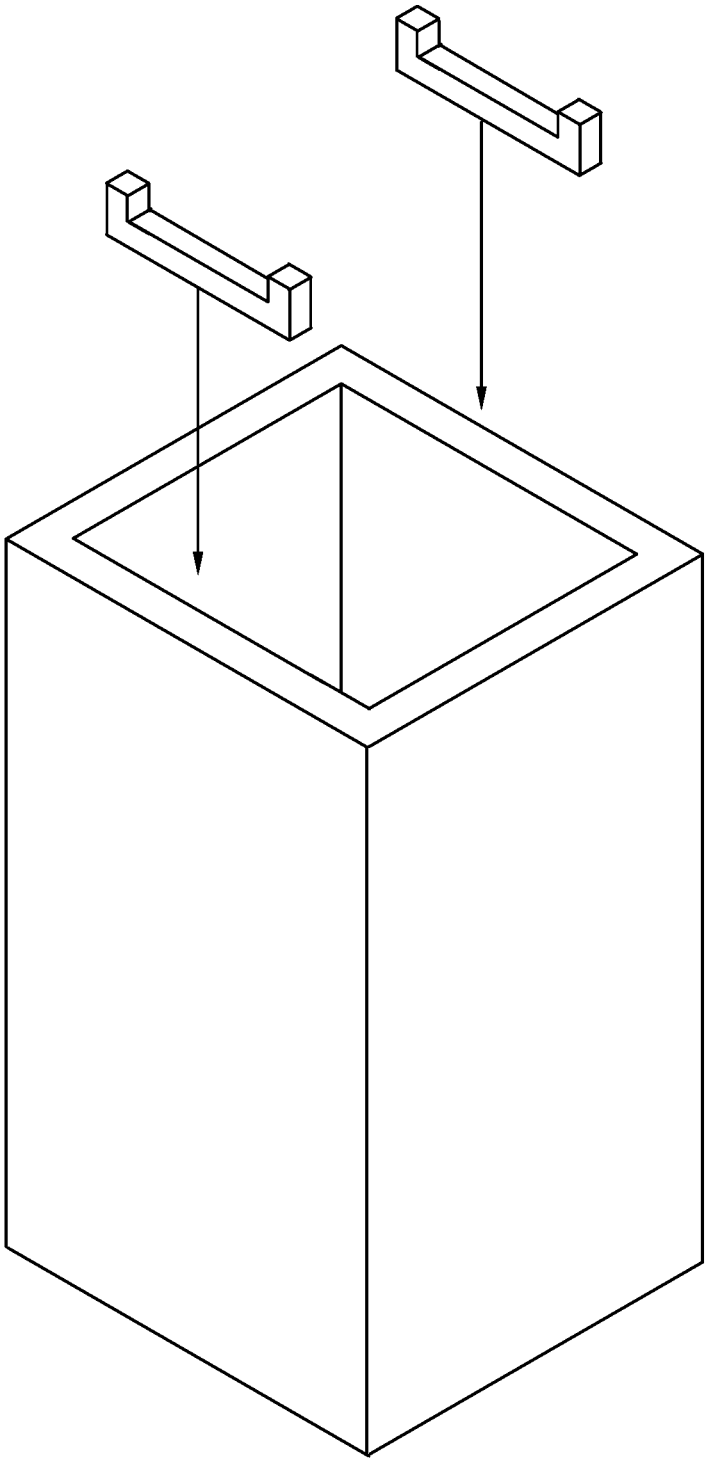
FIG. 9B is an exploded view of the structure of FIG. 9A.

As well, whereas the illustrated securement apparatus includes hooks for engaging the rim of the refuse container, the apparatus could utilize other mechanisms for releasably engaging a refuse container. For example, FIGS. 6-9 show an embodiment wherein brackets 56 are mounted to the walls of the container and closed hooks 58 releasably engage the brackets in use. In the context of containers that terminate in rims with thick, planar, horizontal surfaces, brackets could also be mounted upon such surfaces, as indicated by FIGS. 9A, 9B, which show brackets 56' so mounted; such brackets 56', for example, could conveniently receive the structure of FIG. 2.

Figure 10:
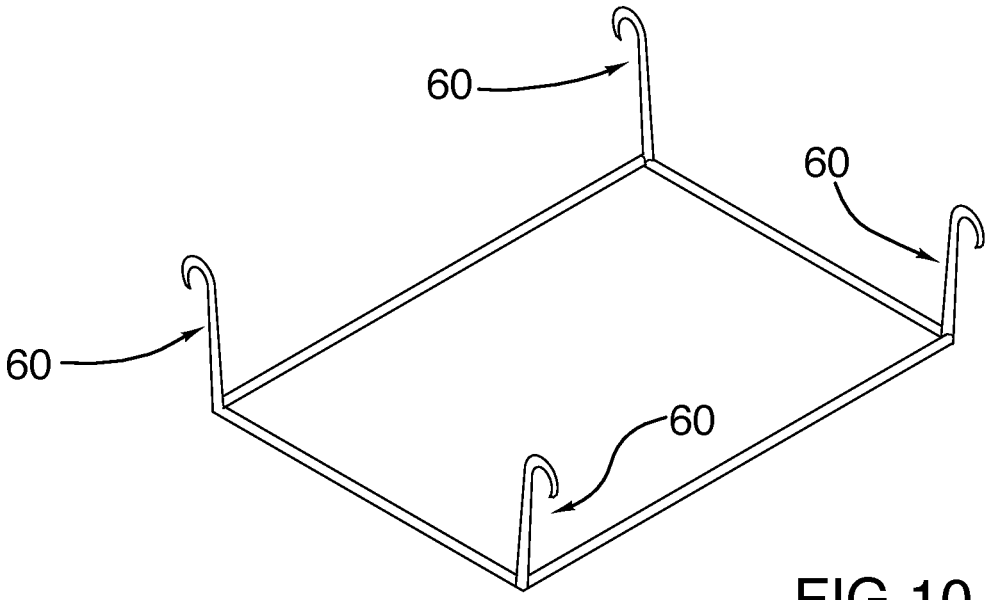
FIG. 10 is a view of a further alternate embodiment of the structure indicated by reference numeral 5 of FIG. 1.
Figure 11:
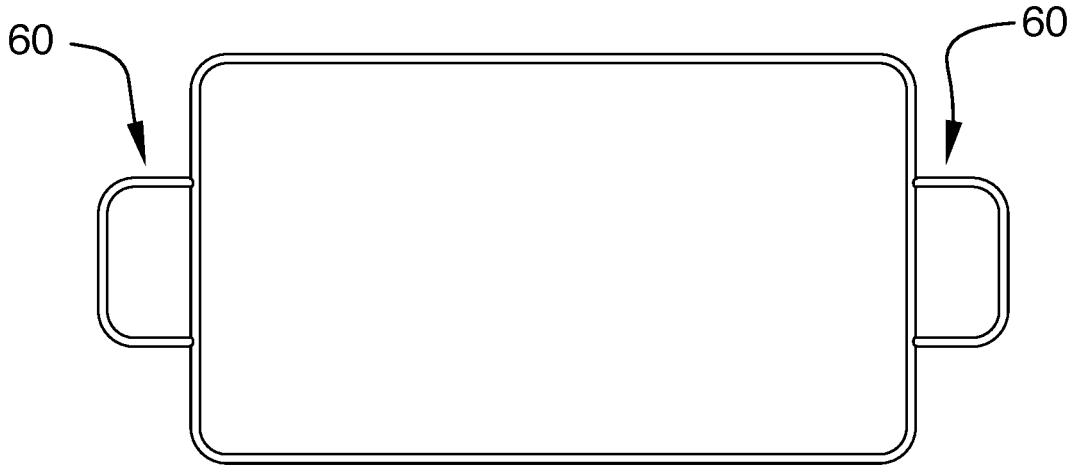
FIG. 11 is a view of a further alternate embodiment of the structure indicated by reference numeral 5 of FIG. 1.

Further, whereas the grips in the exemplary embodiment are pivotally connected, this is not necessary; FIGS. 10 and 11 show embodiment having grips 60 rigidly mounted to the frame. Although structures showing two and four grips are shown, it will be evident that any number of grips could be utilized.

Further, whereas a specific refuse container and refuse bag are illustrated, it will be appreciated that the illustrated apparatus could be used with refuse containers and refuse bags of various sizes by virtue of, inter alia, the hinged connection between the parts and the pivotal connections of the grips.

Moreover, the apparatus could also be varied in size and shape, to accommodate even broader ranges of containers and bags.

As well, whereas the illustrated embodiment shows a refuse container with a hinged lid, it will be appreciated that a lid is not necessary, let alone a hinged lid.

Figure 12:
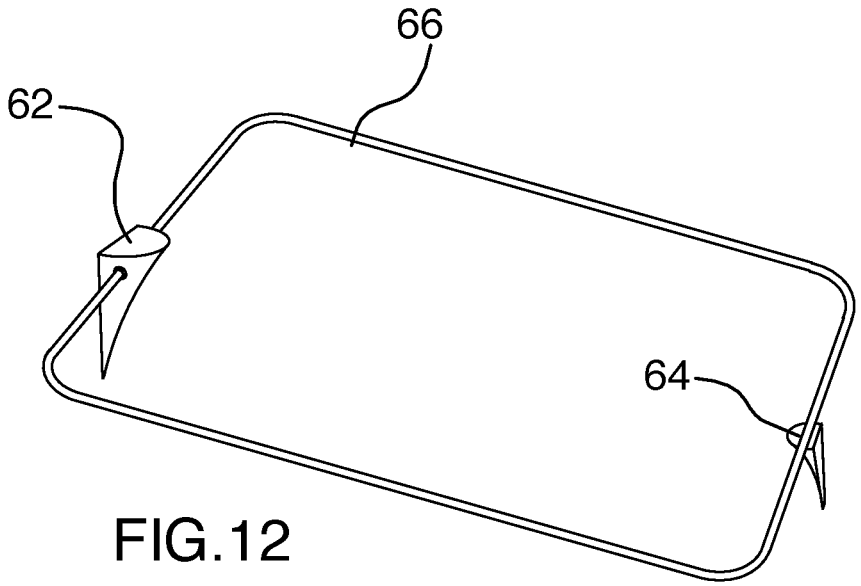
FIG. 12 is a view of an alternate embodiment of the structure indicated by reference numeral 5 of FIG. 1.
Figure 13:
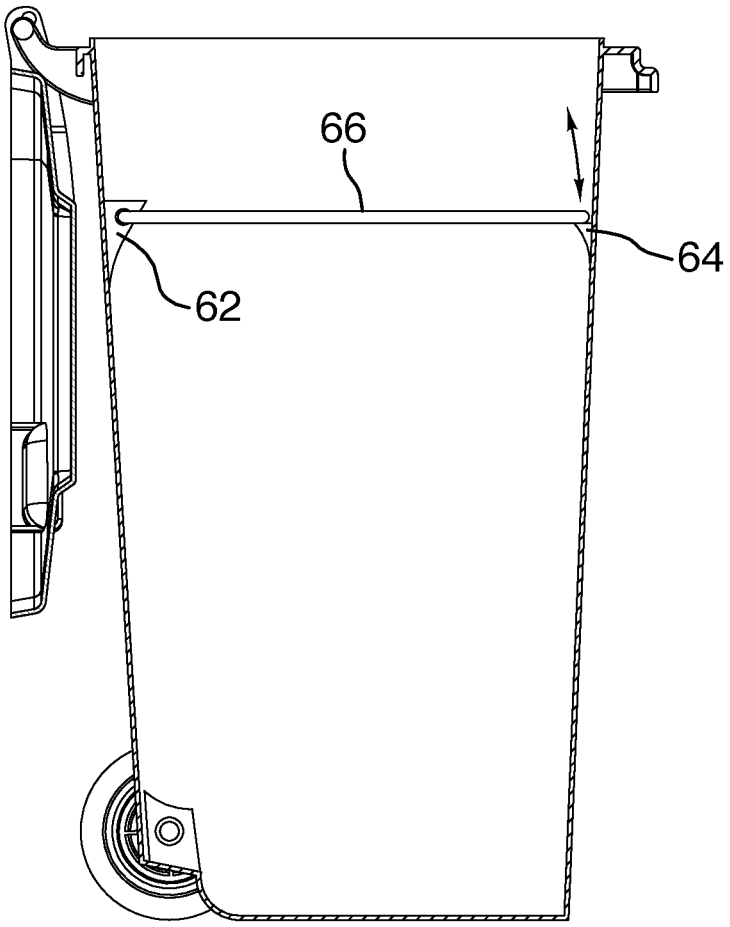
FIG. 13 is a view of the structure of FIG. 12 in use with a refuse container.

Additionally, whereas in the exemplary embodiment, the frame is fully releasable, this is not strictly necessary; FIG. 12 shows an embodiment of the frame and securement means which includes brackets 62, 64 intended for permanent affixation to the container and a frame 66 pivotally mounted to one of the brackets 62 and adapted for snap fit engagement with the other bracket 66, shown mounted for use in FIG. 13.

Figure 14:
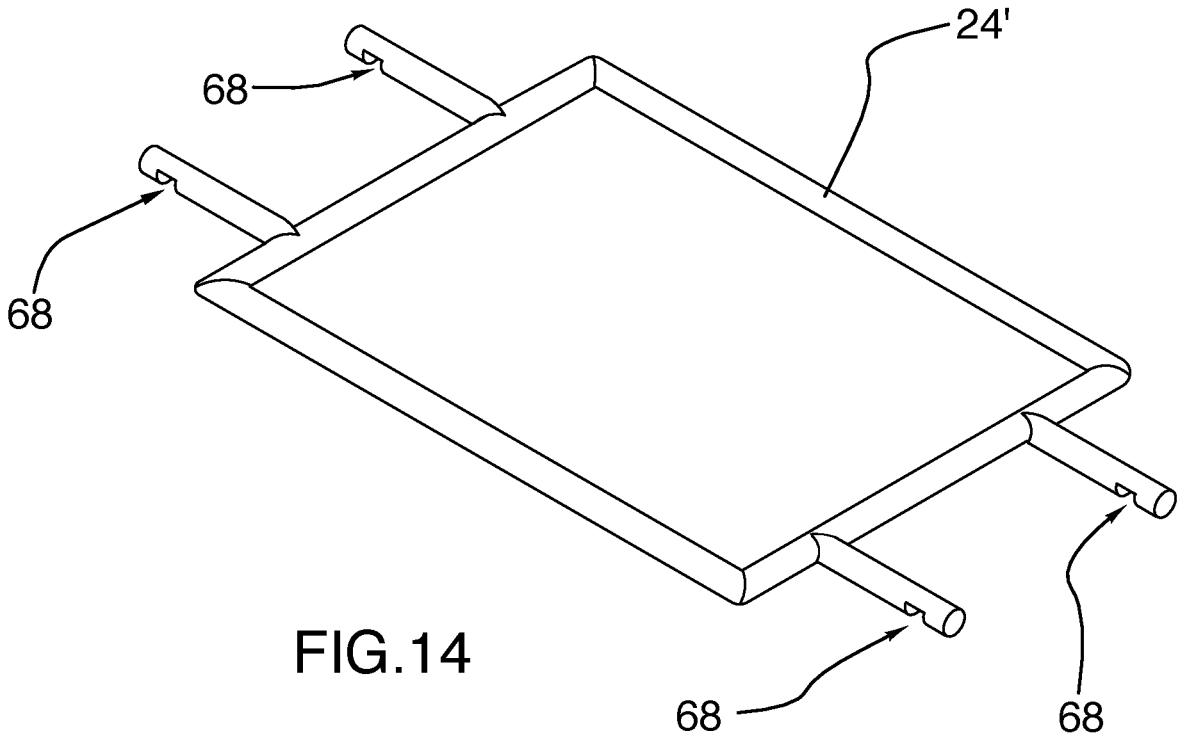
FIG. 14 is a view, similar to FIG. 5, of a yet further alternative embodiment.

Yet further, whereas in the exemplary embodiment, the mouth is suspended beneath the rim of the container, this is not strictly necessary. For example, FIG. 14 shows a version of the frame which is substantially planar, having a plurality of slots 68 defined in the underside of projecting posts, which slots engage the rim of the refuse container in use (not shown).

Figure 15:
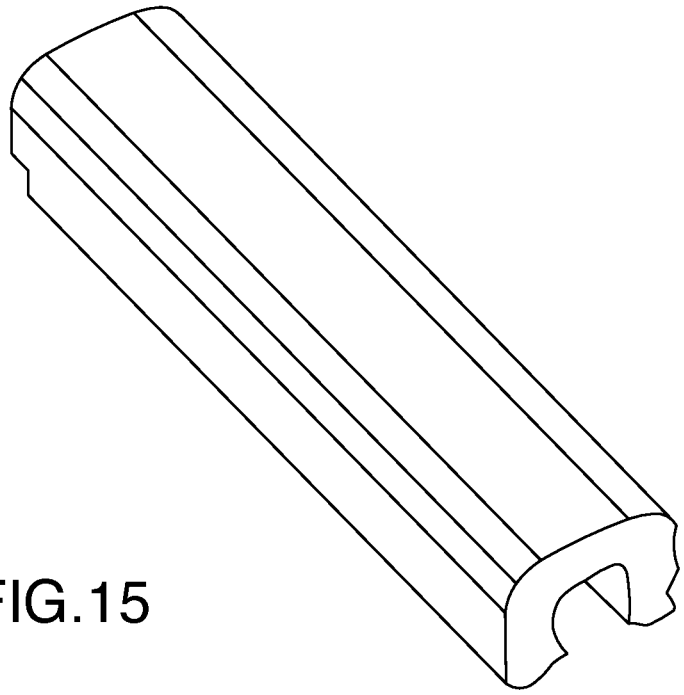
FIG. 15 is a view of an alternative embodiment of the structure of FIG. 1A.

Further, whereas the illustrated clips are provided one for each corner and grip the angularly extending members thereof, the clips could equally grip only a single linear part of the frame; such a clip is shown in FIG. 15. Of course, the clips could have various shapes and need not be resiliently-deformed snap-type clips; for example, spring clips (such as clothespins) could be utilized, as could clips that use turn-screws (such as C-clamps).

Accordingly, the invention should be understood to be limited only by the accompanying claims, purposively construed.

The invention claimed is:

1. Apparatus for use with a refuse container and a refuse bag, the container having a mouth which presents vertically upwardly in use and a rim which defines the entry to the mouth, the bag having an end portion which defines a mouth of the bag; the apparatus comprising:

- a bag holder configured to be disposed at an operative position relative to the container for suspending the bag interiorly of the container such that the mouth of the bag is open, presents upwardly and is disposed adjacent the rim of the container;
- a securement apparatus configured to hold the bag holder at the operative position;
- wherein the bag holder includes a frame configured to be draped by the end portion of the bag; and a plurality of clips adapted to grip around the frame and the bag;

wherein the securement apparatus is defined by a plurality of grips, each grip having a fixed end connected to the frame and a free end configured to releasably couple to the refuse container;

wherein the frame comprises two halves and each half has a plurality of linear sections including a first, second, and third linear section, wherein the first and second linear sections are connected in angular relation and define a first corner, and the second and third linear sections are connected in an angular relation and define a second corner;

wherein one of the plurality of clips is provided on each corner respectively, the clip secured on the first corner being adapted to grip a length of the first and second linear sections, and the clip secured on the second corner being adapted to grip a length of the second and third linear sections, each of the clips having a hook to facilitate removal of the clip from the frame; and wherein the fixed ends of the grips are respectively pivotally connected to the second linear sections for movement around pivot axes defined by the second linear sections.

2. Apparatus according to claim 1, wherein, in respect of each grip, the free end is a hooked end configured to receive the rim in gripping relation.

3. Apparatus according to claim 1, wherein the plurality of grips is a pair of grips, the grips being configured to resist pivotal movement of the bag holder in the container.

4. Apparatus according to claim 1, wherein the mouth of the bag is disposed beneath the rim of the container when the bag is operatively received by the apparatus and the apparatus is operatively received by the container.

* * * * *